US008181785B1

(12) United States Patent
Zeven et al.

(10) Patent No.: US 8,181,785 B1
(45) Date of Patent: May 22, 2012

(54) BARIATRIC BOWL SYSTEM

(76) Inventors: Dezbah Zeven, Land O Lakes, FL (US); Tiffany Jessee-Wylie, Indian Rocks Beach, FL (US)

( * ) Notice: Subject to any disclaimer, the term of this patent is extended or adjusted under 35 U.S.C. 154(b) by 0 days.

(21) Appl. No.: 13/134,071

(22) Filed: May 27, 2011

(51) Int. Cl.
*A45C 11/20* (2006.01)
*B65D 25/04* (2006.01)

(52) U.S. Cl. ..... 206/541; 206/553; 206/561; 220/532

(58) Field of Classification Search ..... 206/541, 206/557, 558, 561, 564, 459.5, 553; 426/115, 426/120; 220/23.83, 23.87, 529, 532, 553
See application file for complete search history.

(56) References Cited

U.S. PATENT DOCUMENTS 2,944,694 A * 7/1960 Kinsey ..... 206/541
3,241,706 A * 3/1966 Monaco et al. ..... 206/558
3,589,554 A * 6/1971 Smith ..... 220/23.83
3,704,779 A * 12/1972 Nigg ..... 220/556
4,807,760 A * 2/1989 Sussman ..... 206/581
6,612,454 B1 * 9/2003 Lin ..... 220/23.88
7,044,424 B2 * 5/2006 Robertson et al. ..... 206/561
2005/0051444 A1 * 3/2005 Hurt et al. ..... 206/315.11

* cited by examiner

*Primary Examiner* — Luan K Bui

(57) ABSTRACT

A first bowl and a second bowl are provided. Each bowl has end walls, side walls and a bottom wall. In this manner a chamber is formed within the bowl. A plurality of sets of reception slots is provided. Each set includes inner and outer slots on the side walls. A plurality of divider panels is selectively positioned in the sets of slots. The panels have angled side edges. The divider panels when inserted into the sets of slots divide the chamber into equal sized segments. First and second lids are adapted to selectively cover and uncover the containers. A retainer ring has end walls, side walls and a bottom wall. In this manner a space is formed within the retainer ring. The length, the width and the depth are of a size to accept the first and the second bowls.

1 Claim, 4 Drawing Sheets

FIG 5
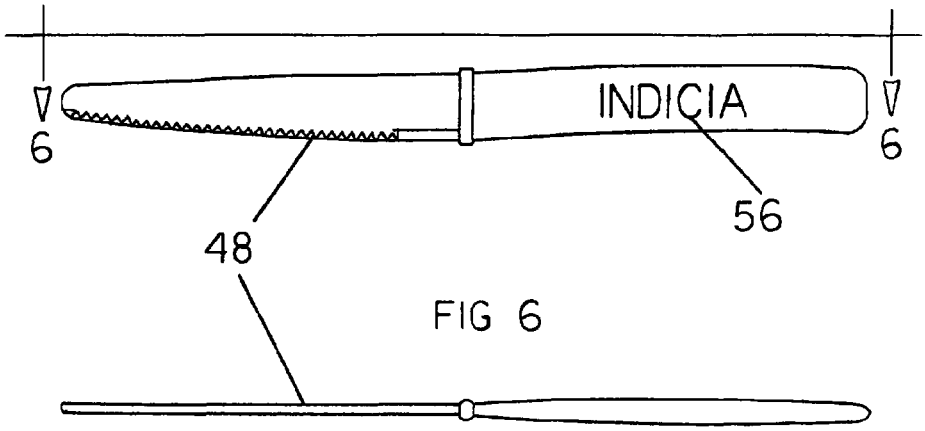
FIG 6
FIG 7
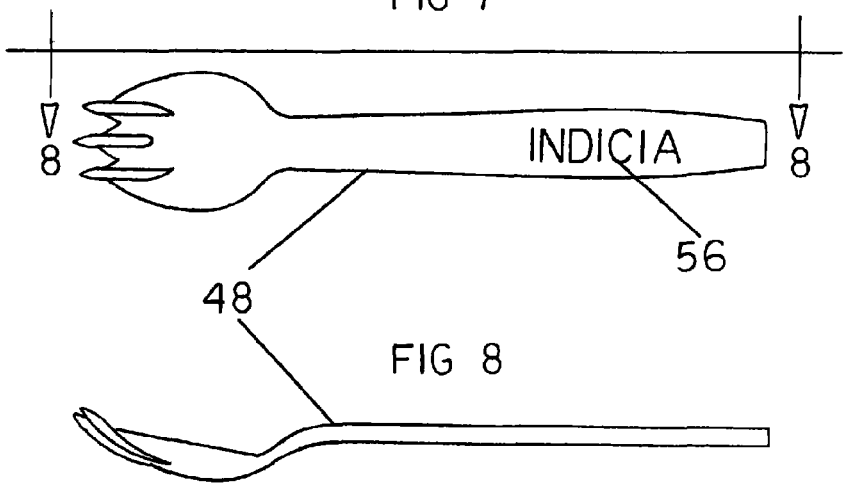
FIG 8

BARIATRIC BOWL SYSTEM

BACKGROUND OF THE INVENTION

Field of the Invention

The present invention relates to a bariatric bowl system and more particularly pertains to receiving and supporting food for a dieting person while selectively measuring the portions of the food, the receiving and the supporting and the measuring being done in a safe, convenient and economical manner.

SUMMARY OF THE INVENTION

In view of the disadvantages inherent in the known types of bowl systems of known designs and configurations now present in the prior art, the present invention provides an improved bariatric bowl system. As such, the general purpose of the present invention, which will be described subsequently in greater detail, is to provide a new and improved bariatric bowl system and method which has all the advantages of the prior art and none of the disadvantages.

To attain this, the present invention essentially comprises a bariatric bowl system. First provided is a generally rectilinear first bowl. Also provided is a similarly configured second bowl. Each bowl has end walls. The end walls are separated by a length. Each bowl has side walls. The side walls are separated by a width and a depth. In this manner a chamber is formed within the bowl. The length is between 2 and 3 times the width. The width is between 1.5 and 2.5 times the depth. The chamber has downwardly and inwardly extending opposed inner and outer side walls.

A divider assembly is formed within the chamber. The divider assembly includes three sets of reception slots. Each set of reception slots includes an inner slot. The inner slot is provided on the side wall. Each set of reception slots includes a laterally spaced outer slot. The outer slot is provided on the outer wall. A plurality of divider panels is provided. The divider panels are selectively positioned in the sets of slots. The panels have horizontal upper and lower edges. The panels have downwardly angled side edges. The side edges each form an angle with respect to the vertical of between 10 and 20 degrees. The divider panels when inserted into the sets of slots divide the chamber into equal sized segments. The segments are equal to 25 and 50 and 75 percent of the size of the chamber.

A generally rectilinear first receptacle is provided. Also provided is a similarly configured second receptacle. Each receptacle has end walls. The end walls are separated by a length. Each receptacle has side walls. The side walls are separated by a width and a depth. In this manner a space is formed within the receptacle. The length is between 8 and 12 times the width. The width is between 1.0 and 1.5 times the depth. One side wall of the first container is integrally formed with one side wall of the first receptacle. In this manner a first container/receptacle is formed. One side wall of the second container is integrally formed with one side wall of the second receptacle. In this manner a second container/receptacle is formed.

A first lid is provided next. The first lid is adapted to selectively cover and uncover the first container/receptacle. A second lid is provided. The second lid is adapted to selectively cover and uncover the second container/receptacle.

Provided next are utensils. The utensils include a knife and a fork/spoon. The knife and fork/spoon are adapted to be positioned and stored in the receptacle. The knife and fork/spoon are further adapted to be removed for use in eating food in the containers.

Further provided is a retainer ring. The retainer ring has end walls. The end walls are separated by a length. The retainer ring has side walls. The side walls are separated by a width and a depth. In this manner a space is formed within the retainer ring. The length, the width and the depth are of a size to accept the first container/receptacle and the second container/receptacle with the first and second receptacles in contact with each other. The retainer ring, the bowls, the receptacles and the lids are fabricated of a low density polyethylene.

Provided last are indicia. The indicia are formed on the knife and the fork/spoon and the lids and the divider panels.

The present invention is designed to have two bowl, one for protein sources and one for vegetables. In each bowl is a divider panel functioning as a sizer to allow a user to create a desired portion size such as 1 ounce, 2 ounces, 3 ounces or 4 ounces. There are may different types of weight loss surgeries in which each one will allow patients to consume varying amounts. The present invention will aid the patient and the physician to be able to communicate the exact amounts a patient is consuming, which is an important aspect of follow up. Also, the patient will be able to measure his or her food and know exactly what the limits should be. In addition, we recognize that it might be convenient if they were able to microwave one bowl and leave the other bowl cold which is why we incorporate the retainer ring. After microwaving the contents of one bowl, such bowl is replaced in the retainer ring for eating together the entire meal.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bariatric bowl system which has all of the advantages of the prior art bowl systems of known designs and configurations and none of the disadvantages.

It is another object of the present invention to provide a new and improved bariatric bowl system which may be easily and efficiently manufactured and marketed.

It is further object of the present invention to provide a new and improved bariatric bowl system which is of durable and reliable constructions.

An even further object of the present invention is to provide a new and improved bariatric bowl system which is susceptible of a low cost of manufacture with regard to both materials and labor, and which accordingly is then susceptible of low prices of sale to the consuming public, thereby making such bariatric bowl system economically available to the buying public.

Even still another object of the present invention is to provide a bariatric bowl system for receiving and supporting food for a dieting person while selectively measuring the portions of the food, the receiving and the supporting and the measuring being done in a safe, convenient and economical manner.

Lastly, it is an object of the present invention to provide a new and improved bariatric bowl system. A first bowl and a second bowl are provided. Each bowl has end walls, side walls and a bottom wall. In this manner a chamber is formed within the bowl. A plurality of sets of reception slots is provided. Each set includes inner and outer slots on the side walls. A plurality of divider panels is selectively positioned in the sets of slots. The panels have angled side edges. The divider panels when inserted into the sets of slots divide the chamber into equal sized segments. First and second lids are adapted to selectively cover and uncover the containers. A retainer ring has end walls, side walls and a bottom wall. In this manner a space is formed within the retainer ring. The length, the width and the depth are of a size to accept the first and the second bowls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a front elevational view of one knife for use with the bowls of FIGS. 1 and 2.

FIG. 6 is a plan view of the knife taken along line 6-6 of FIG. 5.

FIG. 7 is a front elevational view of one fork/spoon for use with the bowls of FIGS. 1 and 2.

FIG. 8 is a plan view of the fork/spoon taken along line 8-8 of FIG. 7.

The same reference numerals refer to the same parts throughout the various Figures.

DESCRIPTION OF THE PREFERRED EMBODIMENT

Figure 1:
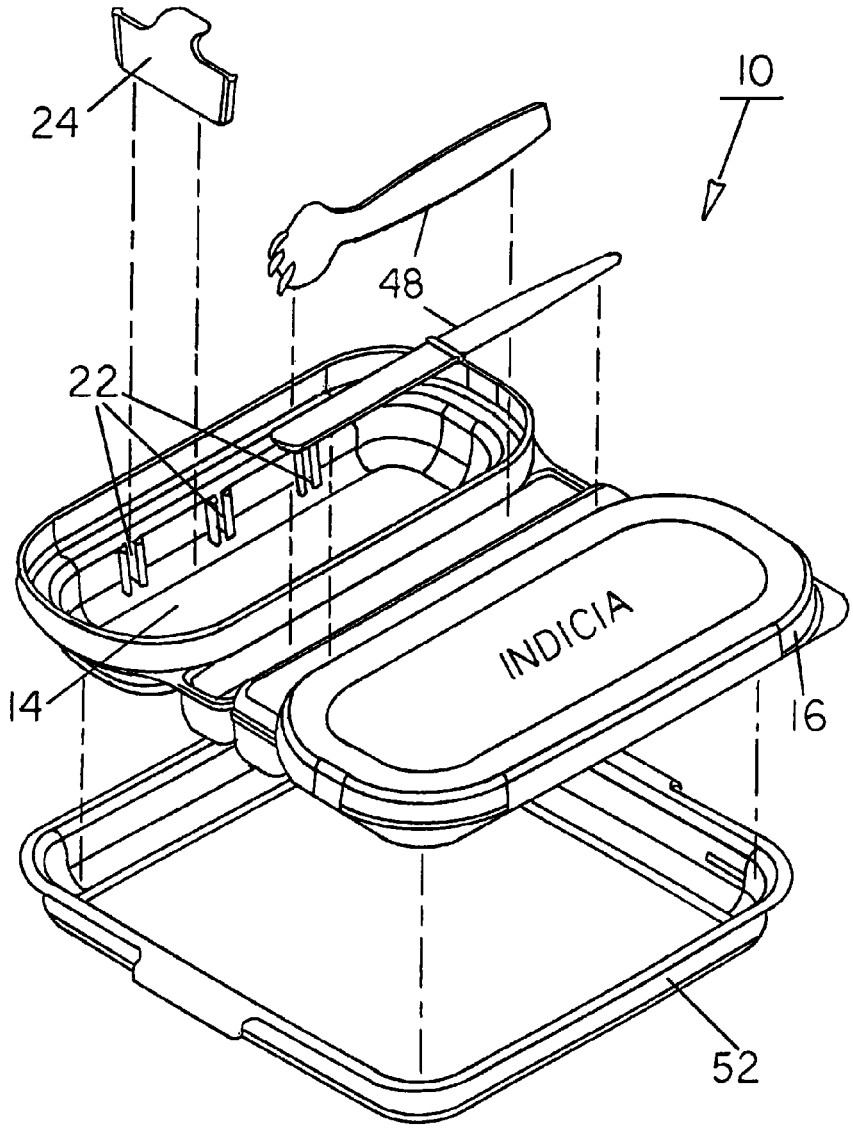
FIG. 1 is an exploded perspective illustration of a bariatric bowl system constructed in accordance with the principles of the present invention.
Figure 2:
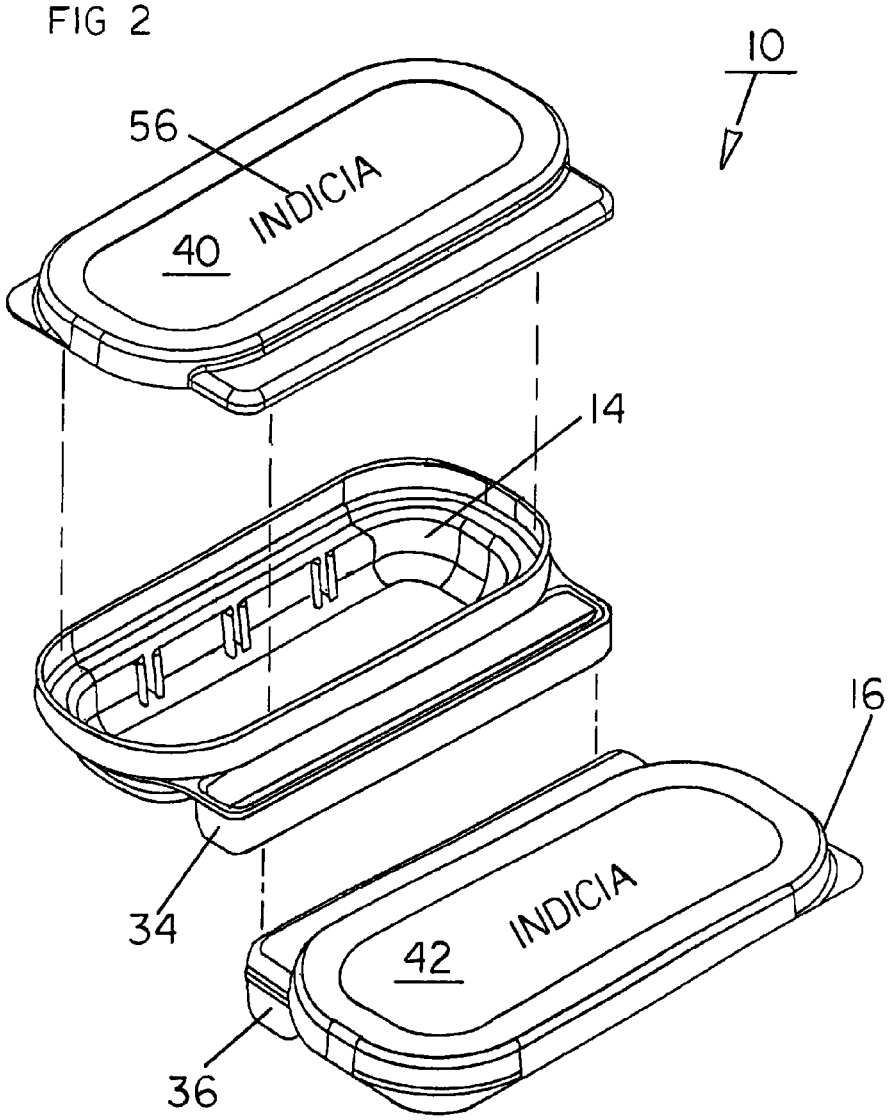
FIG. 2 is an exploded perspective illustration of the bowls and lids of FIG. 1.

With reference now to the drawings, and in particular to FIG. 1 thereof, the preferred embodiment of the new and improved bariatric bowl system embodying the principles and concepts of the present invention and generally designated by the reference numeral 10 will be described.

The present invention, the bariatric bowl system 10 is comprised of a plurality of components. Such components in their broadest context include a first bowl and a second bowl, a plurality of sets of reception slots, first and second lids and a retainer ring. Such components are individually configured and correlated with respect to each other so as to attain the desired objective.

First provided is a generally rectilinear first bowl 14. Also provided is a similarly configured second bowl 16. Each bowl has end walls. The end walls are separated by a length. Each bowl has side walls. The side walls are separated by a width and a depth. In this manner a chamber is formed within the bowl. The length is between 2 and 3 times the width. The width is between 1.5 and 2.5 times the depth. The chamber has downwardly and inwardly extending opposed inner and outer side walls.

Figure 3:
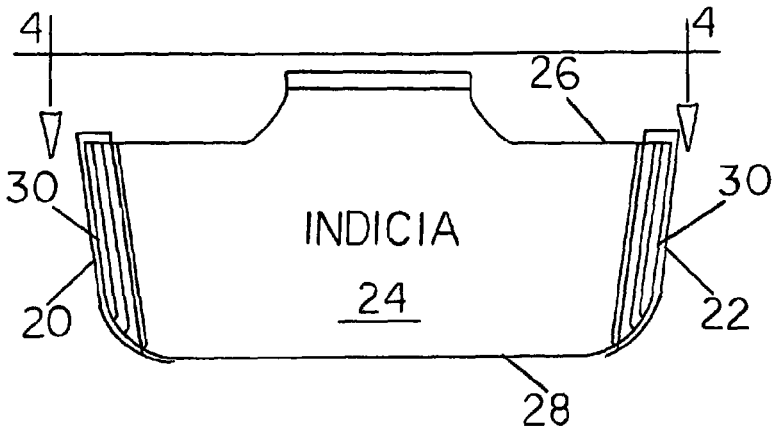
FIG. 3 is a front elevational view of one selectively positionable divider for use with the bowls of FIGS. 1 and 2.
Figure 4:
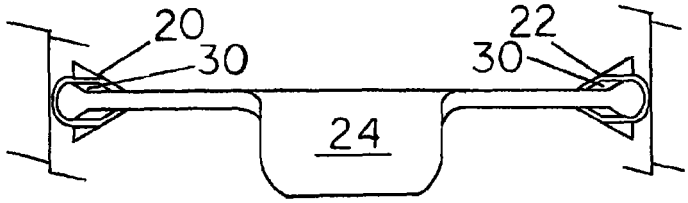
FIG. 4 is a plan view of the divider taken along line 4-4 of FIG. 3.

A divider assembly is formed within the chamber. The divider assembly includes three sets of reception slots 20, 22. Note FIGS. 1, 3 and 4. Each set of reception slots includes an inner slot 20. The inner slot is provided on the side wall. Each set of reception slots includes a laterally spaced outer slot 22. The outer slot is provided on the outer wall. A plurality of divider panels 24 is provided. The divider panels are selectively positioned in the sets of slots. The panels have horizontal upper and lower edges 26, 28. The panels have downwardly angled side edges 30. The side edges each form an angle with respect to the vertical of between 10 and 20 degrees. The divider panels when inserted into the sets of slots divide the chamber into equal sized segments. The segments are equal to 25 and 50 and 75 percent of the size of the chamber.

A generally rectilinear first receptacle 34 is provided. Also provided is a similarly configured second receptacle 36. Each receptacle has end walls. The end walls are separated by a length. Each receptacle has side walls. The side walls are separated by a width and a depth. In this manner a space is formed within the receptacle. The length is between 8 and 12 times the width. The width is between 1.0 and 1.5 times the depth. One side wall of the first container is integrally formed with one side wall of the first receptacle. In this manner a first container/receptacle is formed. One side wall of the second container is integrally formed with one side wall of the second receptacle. In this manner a second container/receptacle is formed.

A first lid 40 is provided next. The first lid is adapted to selectively cover and uncover the first container/receptacle. A second lid 42 is provided. The second lid is adapted to selectively cover and uncover the second container/receptacle.

Provided next are utensils 48. The utensils include a knife and a fork/spoon. The knife and fork/spoon are adapted to be positioned and stored in the receptacle. The knife and fork/spoon are further adapted to be removed for use in eating food in the containers.

Further provided is a retainer ring 52. The retainer ring has end walls. The end walls are separated by a length. The retainer ring has side walls. The side walls are separated by a width and a depth. In this manner a space is formed within the retainer ring. The length, the width and the depth are of a size to accept the first container/receptacle and the second container/receptacle with the first and second receptacles in contact with each other. The retainer ring, the bowls, the receptacles and the lids are fabricated of a low density polyethylene.

Provided last are indicia 56. The indicia are formed on the knife and the fork/spoon and the lids and the divider panels.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bariatric bowl system (10) for receiving and supporting food for a dieting person while selectively measuring the portions of the food, the receiving and the supporting and the measuring being done in a safe, convenient and economical manner, the system comprising, in combination:

a generally rectilinear first bowl (14) and a similarly configured second bowl (16), each bowl having end walls separated by a length and side walls separated by a width and a depth forming a chamber there within, the length being between 2 and 3 times the width, the width being between 1.5 and 2.5 times the depth, the chamber having downwardly and inwardly extending opposed inner and outer side walls;

a divider assembly formed within the chamber, the divider assembly including three sets of reception slots (20), (22), each set of reception slots including an inner slot (20) on the side wall and a laterally spaced outer slot (22) on the outer wall, a plurality of divider panels (24) selectively positioned in the sets of slots, the panels having horizontal upper and lower edges (26), (28) and downwardly angled side edges (30), the side edges each forming an angle with respect to the vertical of between 10 and 20 degrees, the divider panels when inserted into the sets of slots dividing the chamber into equal sized segments equal to 25 and 50 and 75 percent of the size of the chamber;

a generally rectilinear first receptacle (34) and a similarly configured second receptacle (36), each receptacle having end walls separated by a length and side walls separated by a width and a depth forming a space there within, the length being between 8 and 12 times the width, the width being between 1.0 and 1.5 times the depth, one side wall of the first bowl being integrally formed with one side wall of the first receptacle to form a first container, one side wall of the second bowl being integrally formed with one side wall of the second receptacle to form a second container;

a first lid (40) adapted to selectively cover and uncover the first container, a second lid (42) adapted to selectively cover and uncover the second container;

utensils (48) including a knife and fork/spoon, the knife and the fork/spoon adapted to be positioned and stored in the receptacle and then removed there from for use in eating food in the containers;

a retainer ring (52) having end walls separated by a length and side walls separated by a width and a depth forming a space there within, the length and width and the depth being of a size to accept the first container and the second container with the first and second receptacles in contact with each other, the retainer ring and the bowls and the receptacles and the lids being fabricated of a low density polyethylene;

indicia (56) formed on the knife and the fork/spoon and the lids and the divider panels.

* * * * *

UNITED STATES PATENT AND TRADEMARK OFFICE

CERTIFICATE OF CORRECTION

PATENT NO. : 8,181,785 B1
APPLICATION NO. : 13/134071
DATED : May 22, 2012
INVENTOR(S) : Dezbah Zevin and Tiffany Jessee-Wylie It is certified that error appears in the above-identified patent and that said Letters Patent is hereby corrected as shown below:

On the Title page, item (12) and (76), delete "ZEVEN" and insert therefor --ZEVIN--.

Signed and Sealed this
Twenty-fourth Day of July, 2012

David J. Kappos

David J. Kappos
*Director of the United States Patent and Trademark Office*